US009938748B1

(12) United States Patent
Powell et al.

(10) Patent No.: US 9,938,748 B1
(45) **Date of Patent: *Apr. 10, 2018**

(54) RAIL FENCE RETRACTOR

(71) Applicants: David L. Powell, Galesburg, IL (US); Steven R. Watts, Galesburg, IL (US)

(72) Inventors: David L. Powell, Galesburg, IL (US); Steven R. Watts, Galesburg, IL (US)

( * ) Notice: Subject to any disclaimer, the term of this patent is extended or adjusted under 35 U.S.C. 154(b) by 801 days.

This patent is subject to a terminal disclaimer.

(21) Appl. No.: 14/454,657

(22) Filed: Aug. 7, 2014

Related U.S. Application Data

(63) Continuation of application No. 13/780,185, filed on Feb. 28, 2013, now abandoned, which is a continuation of application No. 12/263,931, filed on Nov. 3, 2008, now Pat. No. 8,407,872, which is a continuation of application No. 11/599,945, filed on Nov. 15, 2006, now abandoned.

(51) Int. Cl.

| | |
|---|---|
| ***B25B 19/00*** | (2006.01) |
| ***E04H 17/26*** | (2006.01) |
| ***E04H 17/14*** | (2006.01) |

(52) U.S. Cl.
CPC ..... *E04H 17/26* (2013.01); *E04H 17/1413* (2013.01); *E04H 2017/1469* (2013.01)

(58) Field of Classification Search
CPC ..... B25B 27/00; B25B 19/04; B23P 19/04
See application file for complete search history.

(56) References Cited

U.S. PATENT DOCUMENTS

| | | | |
|---|---|---|---|
| 4,198,719 | A | 4/1980 | Feldpausch |
| 4,199,016 | A | 4/1980 | Eads et al. |
| 4,202,532 | A | 5/1980 | Mills |
| 4,287,623 | A | 9/1981 | Tarran |
| 4,685,213 | A | 8/1987 | Powers |
| 4,714,239 | A | 12/1987 | Levine |
| 5,104,094 | A | 4/1992 | Womack |
| 5,601,278 | A | 2/1997 | Graber |
| 5,931,450 | A | 8/1999 | Yoder |
| 6,029,545 | A | 2/2000 | Harpell |
| 6,079,702 | A | 6/2000 | MacDonald |
| 6,098,292 | A | 8/2000 | Harpell |
| 6,267,487 | B1 | 7/2001 | Tucker et al. |
| 6,289,540 | B1 | 9/2001 | Emonds |
| 6,851,985 | B2 | 2/2005 | Lafragette et al. |

(Continued)

*Primary Examiner* — Lee D Wilson
(74) *Attorney, Agent, or Firm* — Hamilton IP Law, PC; Jay R. Hamilton; Charles Damschen

(57) ABSTRACT

A rail fence retractor allowing removal of a fence rail engaged with a fence post comprising a blade having a first and second end. The first end of the blade is configured for insertion into a fence post slot having a rail inserted therein. The rail has self-locking tabs which must be depressed for removal of the rail from the fence post slot. The fence rail retractor also has a handle which is attached to the second end of the blade. The handle allows the application of force against handle to fix the position of the handle against the fence post during removal of the rail from the fence post slot. The handle is also useful in carrying the rail fence retractor when not in use. The handles of the rail fence retractor may be configured to allow integration with the blade. The handles may be also be configured to allow a pair of rail fence retractors to fit or snap together when not in use.

17 Claims, 9 Drawing Sheets

(56) References Cited

U.S. PATENT DOCUMENTS

| | | | | |
|---|---|---|---|---|
| 8,407,872 | B2 * | 4/2013 | Powell | E04H 17/1413 254/131.5 |
| 2003/0084545 | A1 | 5/2003 | Cheng | |
| 2003/0110643 | A1 | 6/2003 | Wickline | |
| 2005/0005500 | A1 | 1/2005 | Howley | |
| 2009/0056095 | A1 * | 3/2009 | Powell | E04H 17/1413 29/270 |

* cited by examiner

RAIL FENCE RETRACTOR

CROSS REFERENCE TO RELATED APPLICATIONS

This patent application is a continuation of patent application Ser. No. 13/780,185 previously filed on Feb. 28, 2013, which application was a continuation of patent application Ser. No. 12/263,931 previously filed on Nov. 3, 2008, now U.S. Pat. No. 8,407,872, which application was a continuation of patent application Ser. No. 11/599,945 previously filed on Nov. 15, 2006, now abandoned, and applicant herein claims priority from said applications, all of which are incorporated herein in their entireties.

FIELD OF INVENTION

Solid or hollow rail fences having rails with self-locking tabs located at the end of the rail for insertion into and engagement with a fence posts. More particularly, a rail fence retractor allowing extraction of said fence rails from said fence posts.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

DETAILED DESCRIPTION—LISTING OF ELEMENTS

| ELEMENT DESCRIPTION | ELEMENT # |
|---|---|
| Fence | 1 |
| Ground | 2 |

-continued

| ELEMENT DESCRIPTION | ELEMENT # |
|---|---|
| Fence post | 3 |
| Fence post cap | 4 |
| Rail | 5 |
| Fence post slot | 6 |
| Locking tab | 7 |
| Slot wall | 8 |
| Locking clasp | 9 |
| Retractor | 10 |
| Retractor handle | 11 |
| Retractor blade | 12 |
| Blade angle | 13 |
| Retractor strap | 14 |
| Retractor string | 15 |
| Screws | 16 |
| Two-piece retractor handle | 17 |
| 90 degree angle in Blade | 18 |
| Vertical groove retractor handle | 19 |

DETAILED DESCRIPTION

Figure 1:
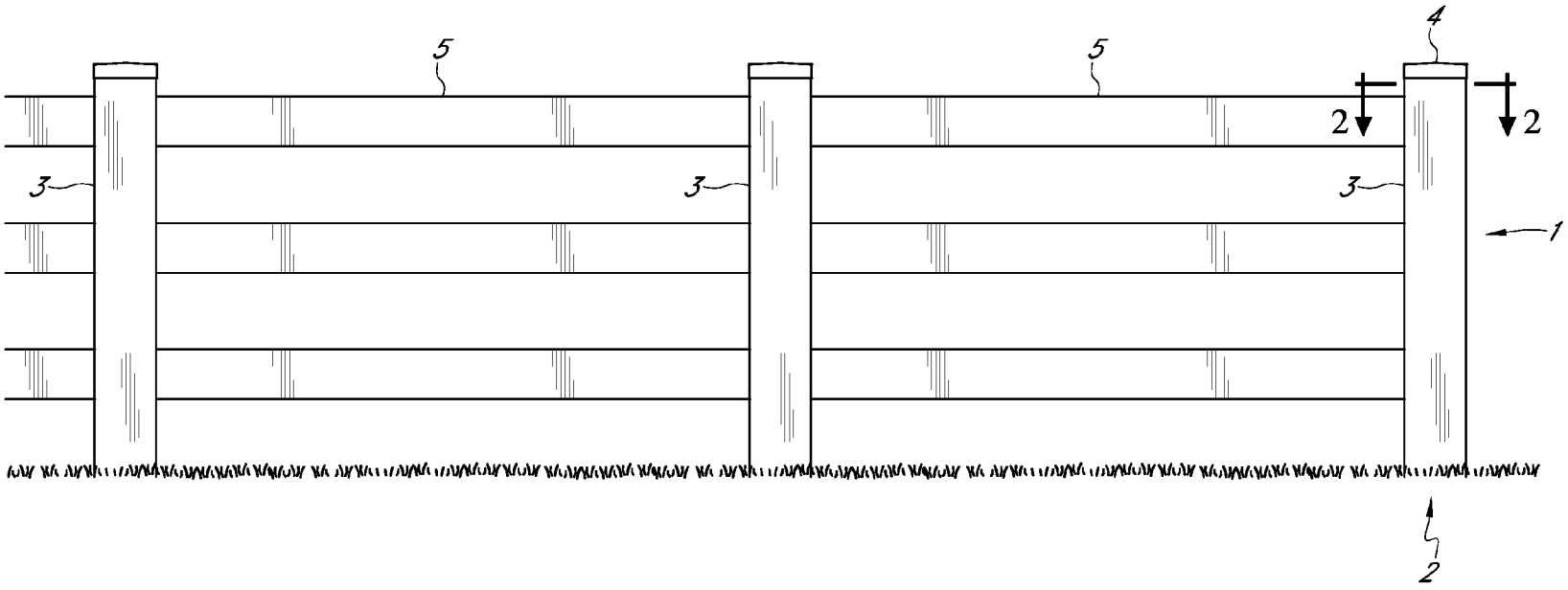
FIG. 1 is an overview of a three rail fence as found in the prior art.
Figure 2:
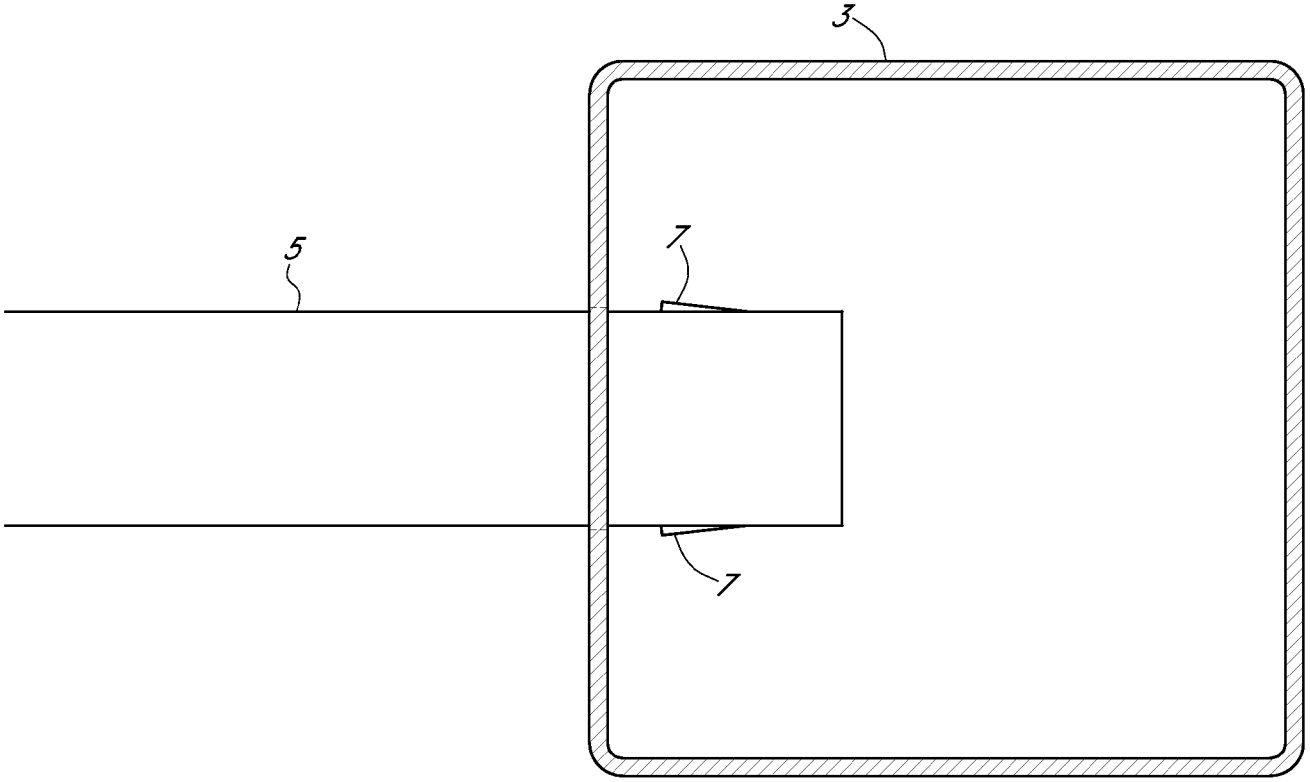
FIG. 2 is a top segment view of a rail having self-locking tabs inserted into and engaged with a fence post.
Figure 3:
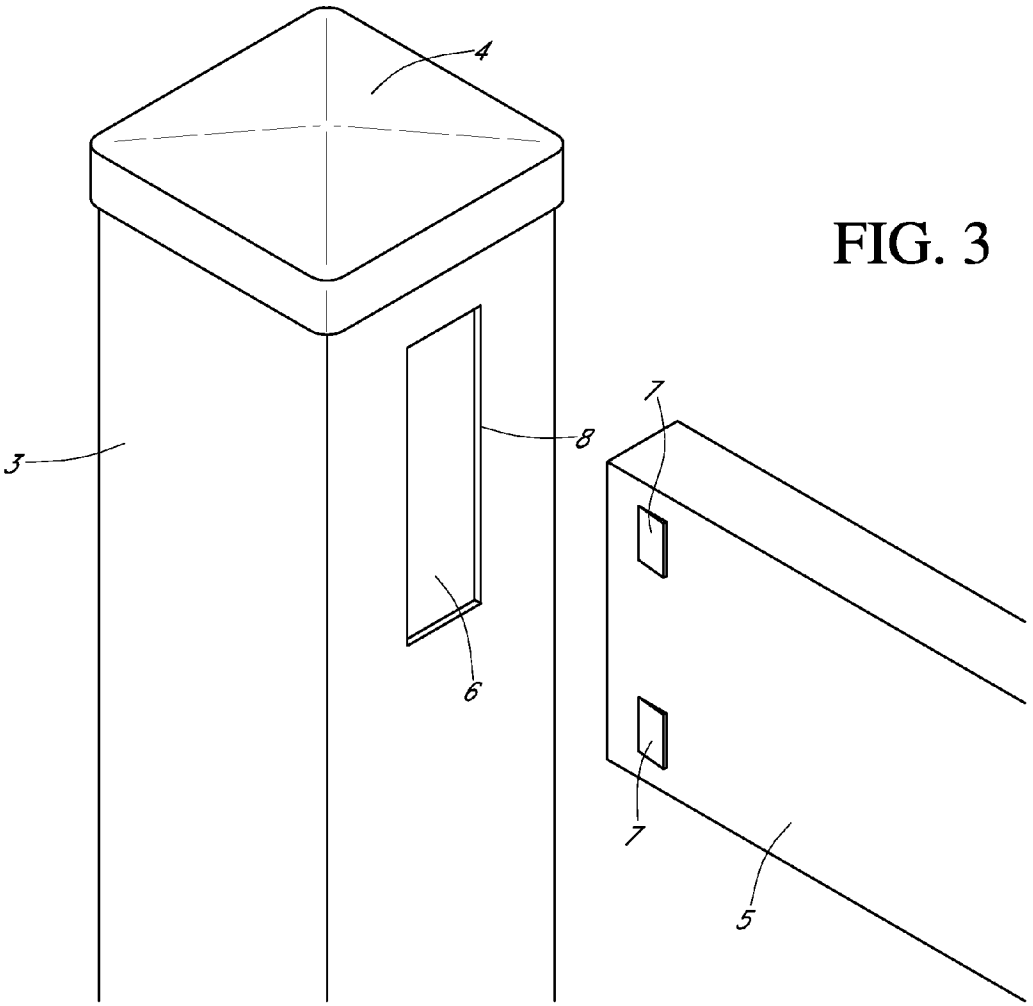
FIG. 3 illustrates a fence rail having self-locking tabs prior to insertion in the fence post as found in the prior art.

Referring now to the drawings, wherein like reference numerals designate identical or corresponding parts throughout the several views, wherein the prior art is shown in FIGS. 1,2 and 3.

FIG. 1 provides an example of the prior art side rail fence 1 commonly available in the market place. This type of fence 1 is commonly used by ranchers and farmers for fencing livestock in or out. It is made using vinyl or vinyl derivative for improved weather resistance, decreased weight and relatively high strength. No additional hardware and a minimum of tools are necessary to install this type of fence thereby increasing its desirability for those requiring a fence. Similarly, the fence may also be produced in ascetically pleasing variations for use by home owners in applications that honor the wooden picket fences of yesterday without requiring carpentry skills for installation. U.S. Pat. No. 5,601,278 and U.S. Pat. No. 4,202,532, incorporated by reference herein, provide more background on fences of this type, as are known to those skilled in the arts.

FIG. 2 presents a top inside view of a fence post 3, with the fence post cap 4 removed, to allow inspection of the rail 5 inserted into the fence post 3. As illustrated in FIG. 2, the rail 5 is allowed a limited amount of movement within the fence post 3 but is restricted from withdrawal from the fence post 3 by the locking tabs 7 which are resilient and are said to be "self-locking."

As shown in FIG. 3, the fence 1 is assembled by sliding the rail 5 into the fence post slot 6. During insertion of the rail 5 into the fence post slot 6, the locking tabs 7 are depressed into the fence rail 5 and slide past the wall of the fence rail slot 8. After insertion, the locking tabs 7 extend out and self-lock into place, thus restricting the removal of the rail 5 from the fence post 3. This system is desirable for construction and installation as demonstrated by the large number of rail fences 1 sold in the market. To date, however, no product is known to be available to allow an installer or fence owner to retract a rail 5 from the fence post 3 without damaging or destroying the self-locking mechanism of the fence rails 5.

Figure 4:
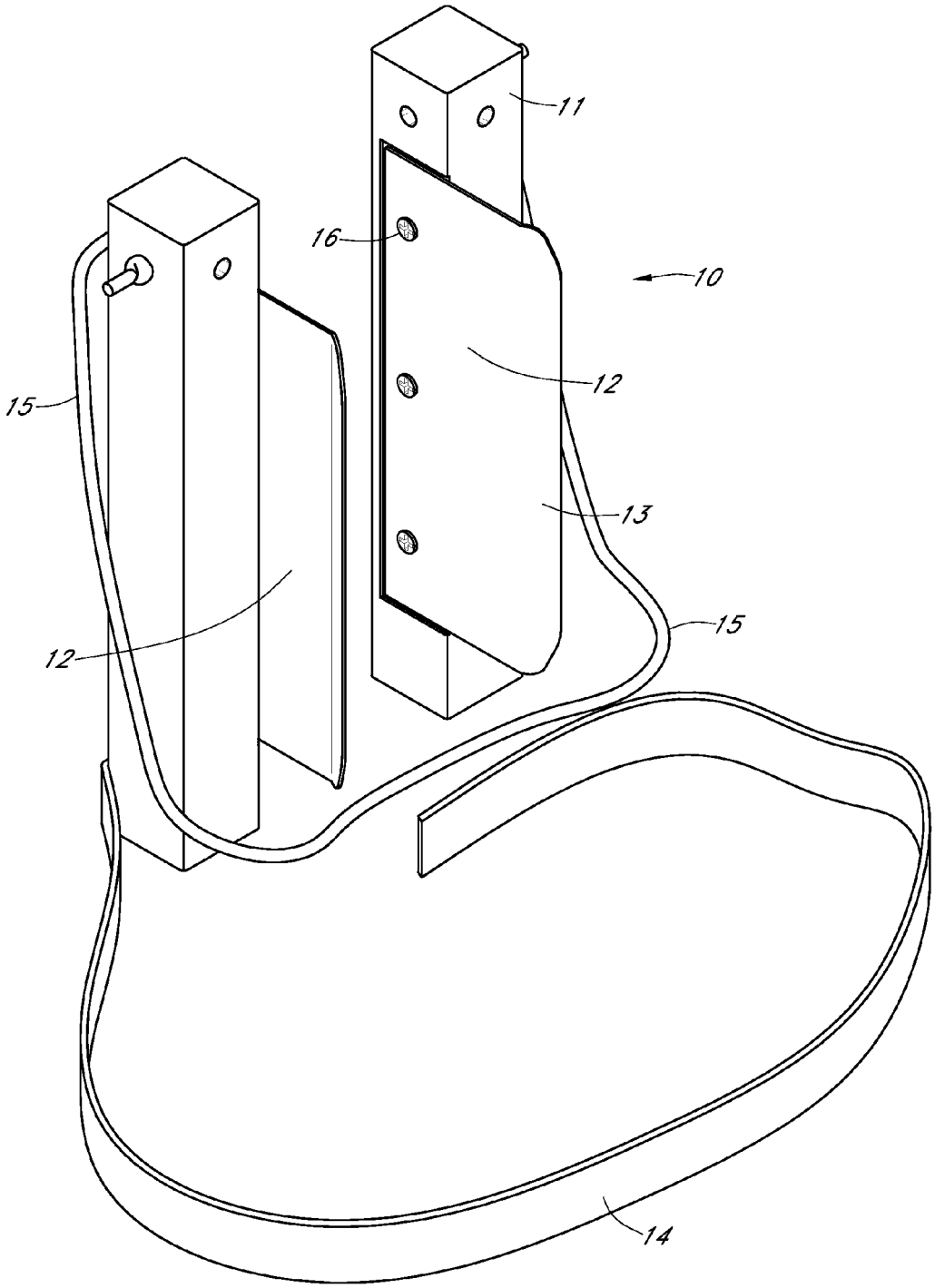
FIG. 4 presents a side view of an embodiment of the rail fence retractor disclosed herein.

FIG. 4 illustrates a fence rail retractor 10 allowing withdrawal of a rail 5 from a fence post 3 without damage to the self-locking mechanism of the rail 5. The retractor 10 is composed of a set of handles each having a retractor blade 12. The retractor blade 12 is formed of resilient material providing adequate flexibility for the retractor blade 12 to engage and slide into the fence post slot 6 having a fence rail 5 positioned therein. Plastic and thin steel are two types of materials that may be used for production of the retractor blades. The thickness of the blade may range from 0.001 inches to 0.015 inches which has been found to allow it to fit between the rail 5 and the slot wall 8 of the fence post slot 6 upon insertion into the fence post 3, in most installations. The surface of the retractor blade 12 is such that it is relatively smooth as to allow the retractor blade 12 to slide into the fence post slot 6 while positioned between the fence rail 5 and fence post slot wall 8.

The angled frontal portion of the retractor blade 13 allows the retractor blade 12 to slide between the slot wall 8 of the fence post 3 and the rail 5 for insertion into the fence post slot 6. As the retractor blade 12 slides in, the angled portion of the retractor blade 13 is more likely to meet and slide up and over the locking tabs 7 to allow full insertion of the retractor blade 12. A retractor blade 12 having a straight front portion has a tendency to meet and "bind" with or on the locking tab 7. During removal of the fence rail 5, the resilient rectractor blade 12 provides the necessary force against the self-locking tab 7 to depress the locking tab 7 and allow removal of the rail 5 from the fence post 3. The rail fence retractor as illustrated in FIG. 4-8 has an angle in the range of 33-35 degrees. Other acceptable alternative angle ranges are in the range of 1-60 degrees.

Figure 5:
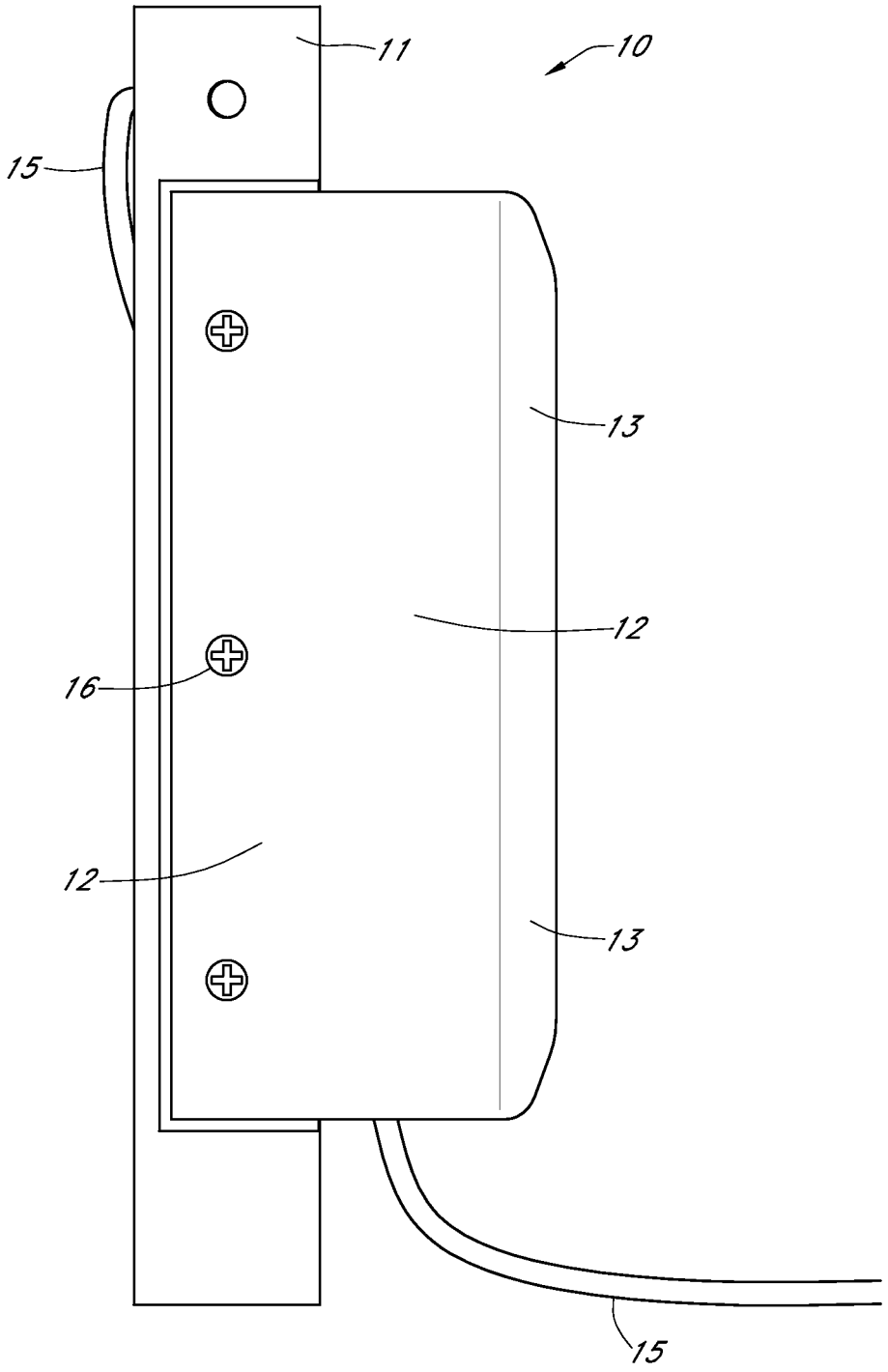
FIG. 5 illustrates the interior surface of the retractor blades.

FIG. 5 depicts an interior side view of one retractor handle 11 and retractor blade 12 to illustrate the interior surface of the retractor blade 12. As shown, the retractor blade 12 is simply mounted to the retractor handle 11 using screws 16. Other methods and means for securement of the retractor handles 11 to the retractor blades 12 are known to those skilled in the art and not described further herein. Although not shown, it is within the scope of this disclosure to include a retractor blade 12 and retractor handle 11 which are integral and produced as one-unit or element.

Figure 6:
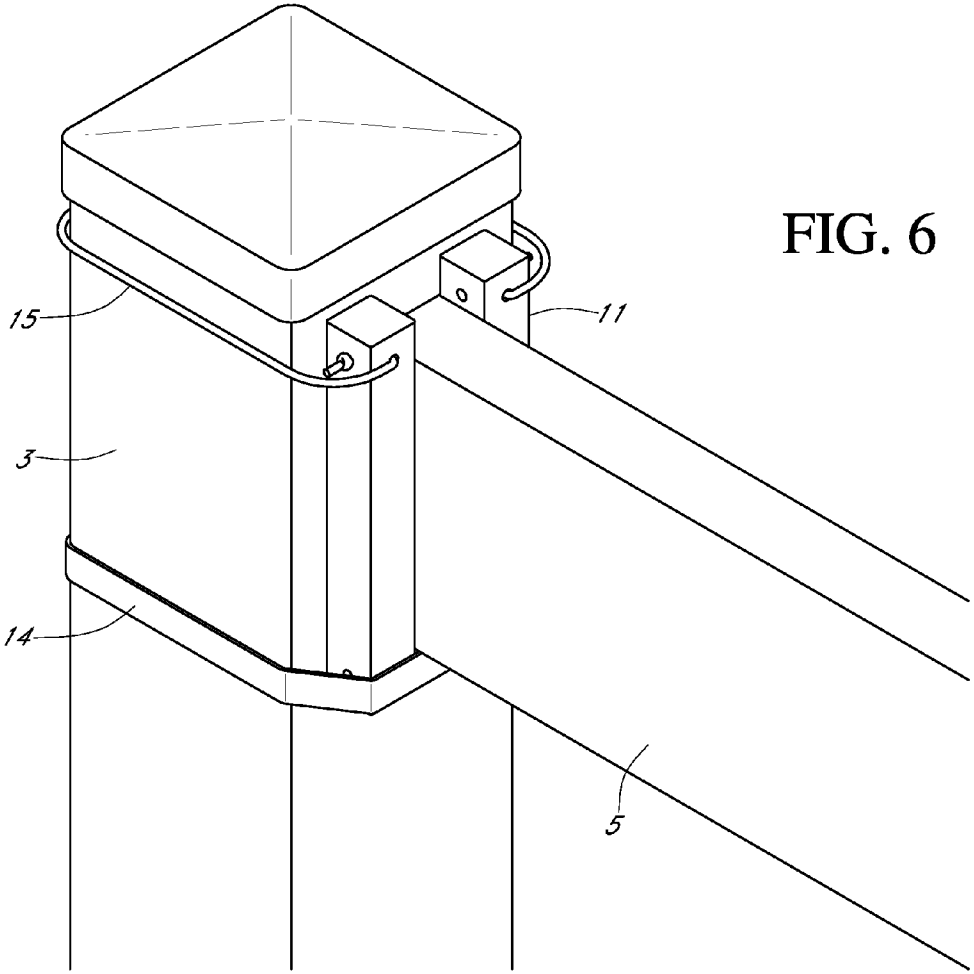
FIG. 6 illustrates the rail fence retractor positioned at the fence post prior to extraction of the fence rail.

FIG. 6 illustrates the rail fence retractor 10 positioned at the fence post 3 prior to extraction of the rail 5. The retractor strap 14, which may be used with the retractor 10, improves operation of the retractor 10 by fixing the position of the retractor relative to the fence rail 5 and fence post 3. Fixing the position of the retractor 10 allows the user to firmly and conveniently grab the rail 5 to remove it from the fence post slot 6 by application of a lateral force. Using the retractor 10 without the straps requires the user to hold the retractor 10 in place while removing the rail 5. As shown, the retractor 10 is paired with a retractor string 15 which provides a convenient way to keep both handles and blades of the retractor 10 paired together and during rail removal, fixes the upper position of the retractor 10 to the fence post 3. In another embodiment, not shown, the string 15 may be replaced with a second retractor strap 14. The retractor strap(s) 14 may be further improved with Velcro ends allowing quick and convenient tightening and re-adjustment. Other methods and means for conveniently keeping the retractor 10 paired together and allowing fixed positioning of the retractor 10 to the fence post 3 will be apparent to those skilled in the art and are within the scope of this disclosure.

Figure 7:
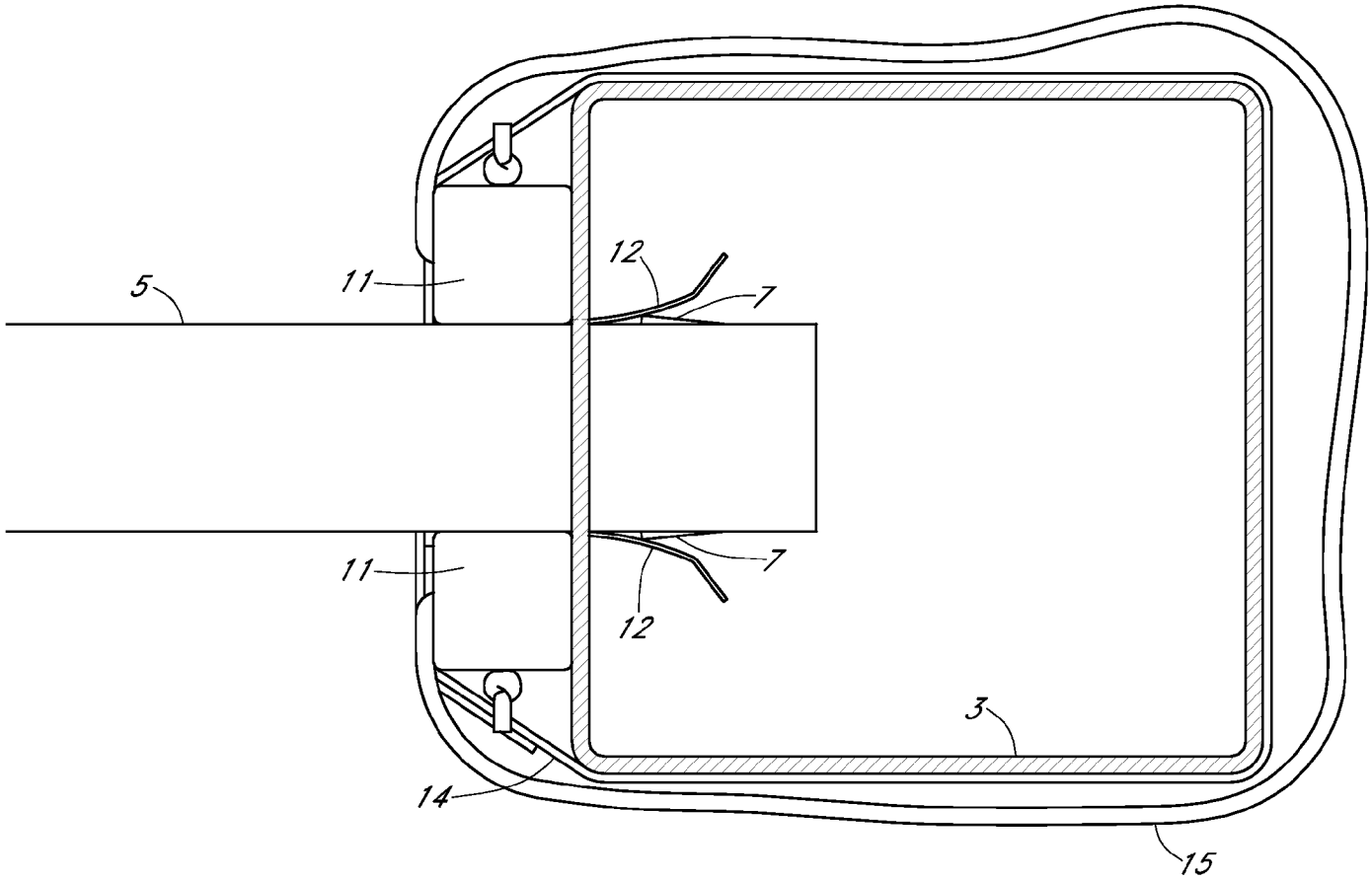
FIG. 7 is a cut-away view of the rail fence retractor positioned at the fence post prior to extraction of the fence rail.
Figure 8:
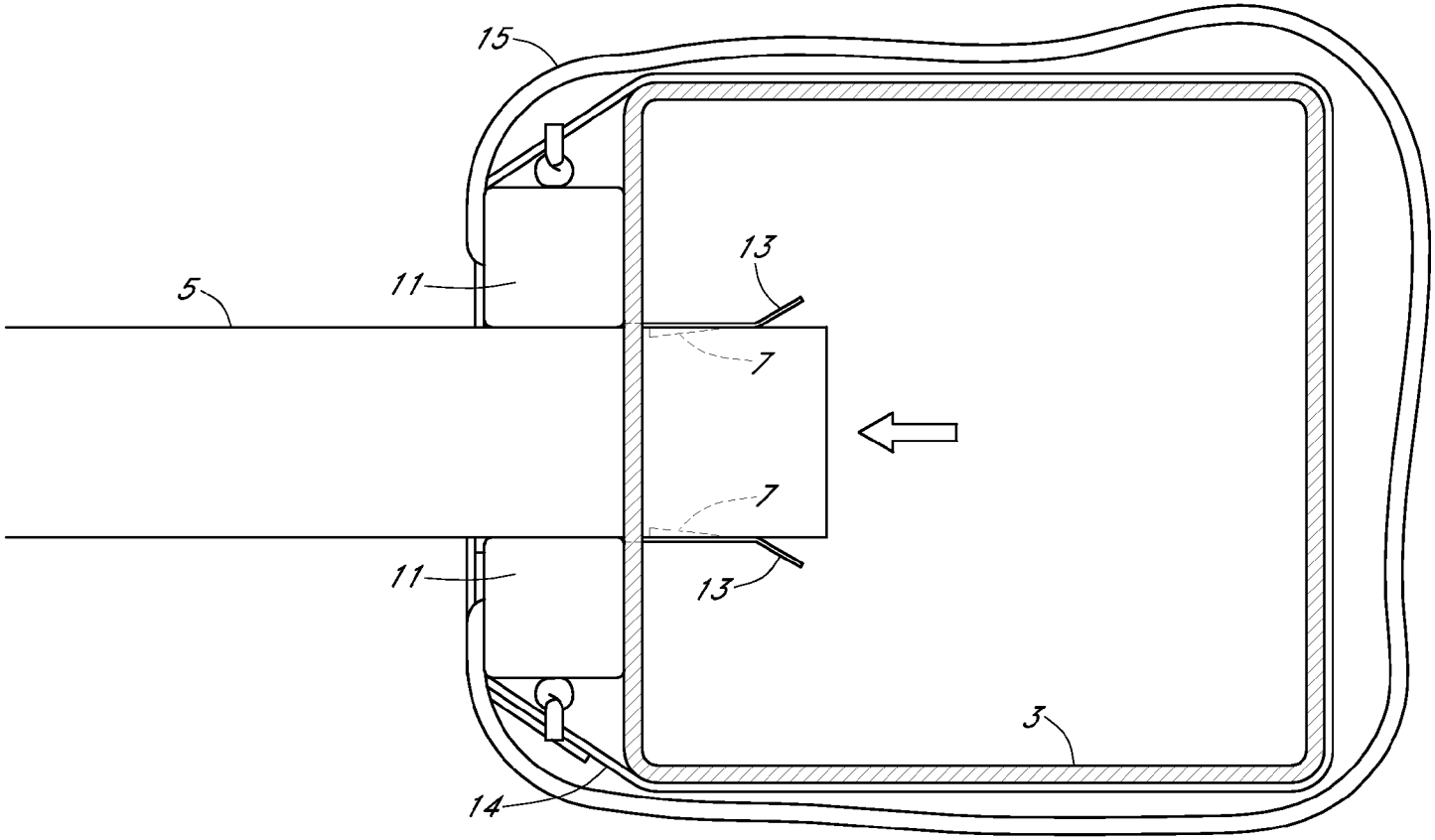
FIG. 8 illustrates the retractor blades depressing the self-locking tabs as the fence rail is removed from the fence post.

FIG. 7 is a cut-away view of the rail fence retractor 10 positioned at the fence post 3 prior to extraction of the fence rail 5. As shown, the locking tabs 7 are engaged with and positioned interior of the retractor blades 12. FIG. 8 illustrates the retractor blades 12 depressing the locking tabs 7 as the rail 5 is pulled out of the fence post slot 6 thereby bypassing or "unlocking" the self-locking function of the locking tabs 7 without destroying or damaging the locking tabs 7, the fence post 6 or the rail 5.

Figure 9:
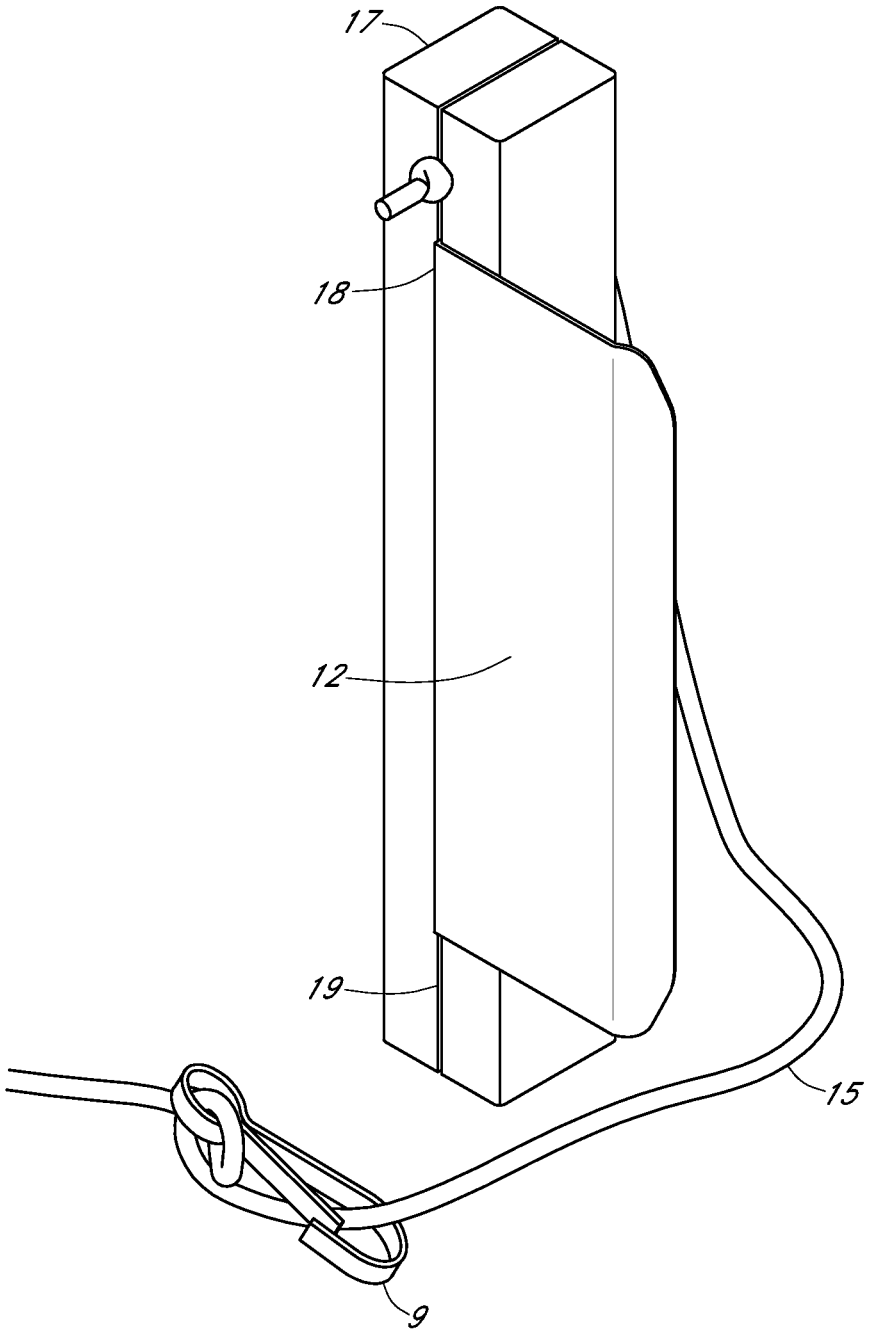
FIG. 9 illustrates another embodiment of the rail fence retractor shown at FIG. 5.

FIG. 9 depicts an interior side view of another embodiment of the retractor handle 11 and retractor blade 12 to illustrate another method of attaching the retractor blade 12 to the retractor handle 17. In this embodiment, the retractor handle 17 has been vertically divided into two separate sections. A ninety degree angle 18 has been placed in the posterior portion of the retractor blade 12 for insertion between the two separate sections of each retractor handle 17. This embodiment improves the securement of the blade within the retractor handle 17 and ensures that the interior surface of the blade 12 is not interrupted by the securement means as shown in FIG. 5. The screws 16 are then inserted into both sides of the retractor handle 11, perpendicular to the ninety degree angle 18 in the blade and parallel with the surface of the retractor blade 12 facing the rail 5. This embodiment of the invention may also be practiced by placing a vertical groove 19 in the retractor handle 11 to simulate sectioning the handle and then inserting the ninety degree angle 18 into said groove 19 prior to securement. Other securement means including bolts or glue may also be used without departing from the spirit or intent of the disclosure. FIG. 9 also illustrates a locking clasp which may be attached to the retractor string 15. The locking clasp 9 is intertwined with retractor string 15. The locking clasp 9 may be adjusted on the retractor string 15 for more or less slack; releasing the rail 5 from the fence post slot 6 sometimes requires a high level of force to be applied to the fence rail 5. This energy release is transferred to the fence rail retractor 10 upon the release creating an opportunity for the fence rail retractor 10 to bounce or rebound erratically. Adjusting the locking clasp 9 to allow little slack in the retractor string 15 reduces the bounce or rebound.

It should be noted that the present invention is not limited to the specific embodiments pictured and described herein, but is intended to apply to all fence rail retractors. Modifications and alterations from the described embodiments will occur to those skilled in the art without departure from the spirit and scope of the present invention.

The invention claimed is:

1. An apparatus allowing removal of a fence rail engaged with a fence post comprising:

a. a left rail fence retractor comprising:

i. a blade having first and second ends, wherein said first end of said blade has a thickness and width allowing insertion into a fence post slot having a rail with depressible locking tabs inserted therein; and, ii. a handle, said handle attached to said second end of said blade wherein said handle allows the application of force against said handle to fix the position of said handle against a fence post during removal of said rail from said fence post slot;

b. a right rail fence retractor comprising:

i. a blade having first and second ends, wherein said first end of said blade has a thickness and width allowing insertion into a fence post slot having a rail with depressible locking tabs inserted therein; and, ii. a handle, said handle attached to said second end of said blade wherein said handle allows the application of force against said handle to fix the position of said handle against a fence post during removal of said rail from said fence post slot, wherein said left rail fence retractor is a mirror-image of said right rail fence retractor.

2. The apparatus as set forth in claim 1 wherein said blades of said left and right rail fence retractors are defined so that an angle between said first and second ends of said blades is in the range of 39-51 degrees.

3. The apparatus as set forth in claim 1 wherein said blades of said left and right rail fence retractors are defined so that the angle between said first and second ends of said blades is in the range of 1-90 degrees.

4. The apparatus as set forth in claim 1 wherein a first strap is attached at a first end of said left rail fence retractor handle and allows said left rail fence retractor to be held against the fence post during removal of said rail from said fence post slot.

5. The apparatus as set forth in claim 4 wherein a second strap is attached at a second end of said left rail fence retractor handle and allows said left rail fence retractor to be held against the fence post during removal of said rail from said fence post slot.

6. The apparatus as set forth in claim 4 wherein said first strap is further defined as also being attached at a first end of said right rail fence retractor handle and allows said right rail fence retractor to be held against the fence post during removal of said rail from said fence post slot.

7. The apparatus as set forth in claim 5 wherein said second strap is further defined as also being attached at a second end of said right rail fence retractor handle and allows said right rail fence retractor to be held against the fence post during removal of said rail from said fence post slot.

8. The apparatus as set forth in claim 1 further comprising a retractor string secured to said handles of said left and right rail fence retractors.

9. The apparatus as set forth in claim 8 further comprising a locking clasp intertwined with said retractor string so as to allow said locking clasp to be fastened upon said retractor string prior to removal of said rail from said fence post slot, wherein said locking clasp serves to limit the amount of slack available in said retractor string.

10. The apparatus as set forth in claim 1 wherein said handles of said left and right rail fence retractors are configured to be integrally constructed with said blades of said left and right rail fence retractors.

11. The apparatus as set forth in claim 1 wherein said handles of said left and right rail fence retractors are further defined as being constructed of a polymeric material.

12. The apparatus as set forth in claim 11 wherein said blades of said left and right rail fence retractors are further defined as being constructed of a metallic material.

13. The apparatus as set forth in claim 1 wherein said handles of said left and right rail fence retractors and said blades of said left and right rail fence retractors are configured to allow said left and right fence rail retractors to fit together when placed in a handle-to-blade orientation.

14. The apparatus as set forth in claim 1 wherein said handles of said left and right rail fence retractors are further defined as having a vertical groove positioned along the length of said handles for insertion of said second end of said first and second blades, and wherein said first and second blades are secured to said handle with screws.

15. The apparatus as set forth in claim 1 wherein said handles of said left and right rail fence retractors are further defined as having a vertical groove positioned along the length of said handles for insertion of said second end of said blades, and wherein said blades are secured to said handles with rivets.

16. The apparatus as set forth in claim 14 further defined so that a portion of said second end of said blades inserted into said vertical groove in said handles is angled with respect to a portion of said second end of said blades not inserted into said vertical groove.

17. The apparatus as set forth in claim 16 wherein said angle between said portion of said second end of said blades not inserted into said vertical groove and said portion of said second end of said blades inserted into said vertical groove is further defined as ninety degrees.

* * * * *